US006475712B1

(12) United States Patent
Wang et al.

(10) Patent No.: US 6,475,712 B1
(45) Date of Patent: Nov. 5, 2002

(54) PHOTOGRAPHIC ELEMENT HAVING IMPROVED SURFACE PROTECTIVE LAYER CONTAINING COMPOSITE WAX PARTICLES

(75) Inventors: Yongcai Wang, Webster, NY (US); Charles C. Anderson, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/996,192

(22) Filed: Nov. 28, 2001

(51) Int. Cl.[7] ..... G03C 1/76; G03C 11/06; G03C 7/22

(52) U.S. Cl. ..... 430/496; 430/505; 430/523; 430/531; 430/536; 430/537; 430/950; 430/961

(58) Field of Search ..... 430/523, 536, 430/537, 961, 950, 531, 496, 505

(56) References Cited

U.S. PATENT DOCUMENTS

| | | | | | |
|---|---|---|---|---|---|
| 2,322,037 | A | | 6/1943 | Lindquist | |
| 2,992,101 | A | | 7/1961 | Jelley et al. | |
| 3,767,448 | A | | 10/1973 | Hutton | |
| 4,094,848 | A | | 6/1978 | Naito | |
| 4,142,894 | A | | 3/1979 | Hori et al. | |
| 4,447,525 | A | | 5/1984 | Vallarino et al. | 430/523 |
| 4,524,131 | A | | 6/1985 | Himmelmann et al. | 430/523 |
| 5,679,505 | A | | 10/1997 | Tingler et al. | 430/523 |
| 5,695,919 | A | | 12/1997 | Wang et al. | 430/537 |
| 5,786,135 | A | | 7/1998 | Anderson et al. | 430/536 |
| 5,958,658 | A | | 9/1999 | Smith et al. | 430/537 |
| 6,048,677 | A | * | 4/2000 | Chen et al. | 430/536 |
| 6,048,678 | A | * | 4/2000 | Schwark et al. | 430/536 |
| 6,068,957 | A | * | 5/2000 | Nair et al. | 430/536 |
| 6,165,702 | A | | 12/2000 | Smith et al. | 430/537 |
| 6,174,661 | B1 | * | 1/2001 | Chen et al. | 430/536 |
| 6,177,239 | B1 | * | 1/2001 | Wang et al. | 430/536 |
| 6,187,521 | B1 | * | 2/2001 | Wang et al. | 430/536 |
| 6,221,571 | B1 | | 4/2001 | Zengerle et al. | 430/546 |

* cited by examiner

*Primary Examiner*—Richard L. Schilling
(74) *Attorney, Agent, or Firm*—Andrew J. Anderson

(57) ABSTRACT

Photographic elements are described which comprise a support, at least one image-forming layer, and at least one surface protective layer that contains a polymeric binder and composite wax particles having a wax phase and a polymer phase, wherein the polymer phase is soluble in alkaline photographic processing solutions. The surface protective layer advantageously enables a change in frictional characteristics after film processing in alkaline solutions which enables the photographic element to have both pre-processed wound roll stability and high post-processed lubricity.

25 Claims, No Drawings

PHOTOGRAPHIC ELEMENT HAVING IMPROVED SURFACE PROTECTIVE LAYER CONTAINING COMPOSITE WAX PARTICLES

FIELD OF THE INVENTION

This invention relates to a photographic element with improved physical properties of its surface layer. More specifically, this invention relates to a photographic element having a surface protective layer that contains a composite wax particle having a wax phase and a polymer phase, where the polymer phase is soluble in alkaline photographic processing solutions.

BACKGROUND OF THE INVENTION

During the manufacture and use of a photographic element, for example, during coating, drying, finishing, winding, rewinding, printing, projecting, and so on, the surfaces of a photographic element are often damaged by contact with various equipment or as a result of contact between the front and back side of the element. This damage is typically scratches or abrasion marks that are visible during viewing of the processed photographic element (i.e., film, slide or paper print). The photographic print itself may be scratched or the scratch may be copied during printing of a damaged negative. In either case, scratch and abrasion represent significant problems in the practical use of photographic films. This is especially true in recent years since the conditions under which photographic materials are manufactured or used have become more severe. For example, in Advanced Photographic System cameras which provide a mid roll interrupt feature the film cassette may be wound and unwound several times before the entire roll of film is exposed. In addition, photographic film and paper are now coated, finished, and printed at higher speeds than ever before in order to improve productivity. Transporting photographic film and paper at these higher speeds make them more susceptible to damage by scratch and abrasion.

To improve scratch and abrasion resistance, a lubricant or slipping agent is often used in the surface layers of photographic elements. Representative examples of the lubricants used for this purpose include silicone derivatives, esters of long-chain fatty acids and alcohols, tetrafluoroethylene particles, natural and synthetic waxes such as paraffin wax, polyethylene wax, and carnauba wax, and others as described in *Research Disclosure*, Number 38957, September 1996, pages 613–614.

The addition of lubricants also lowers the coefficient of friction of the surface layer. In the past, this has been desirable since it improves the transport of the photographic film during manufacture and use. However, the desire to further improve the scratch and abrasion resistance of photographic films has led to the need for large amounts of lubricants in the surface layers, which has resulted in surface layers having a very low coefficient of friction (for example, coefficient of friction values less than about 0.15). Although incorporating high concentrations of lubricants provides excellent resistance to scratch and abrasion, the low coefficient of friction which results from use of such high lubricant levels may compromise the handling and wound roll stability during manufacturing, shipping, and storage of the film. As discussed in U.S. Pat. No. 5,679,505, e.g., when the coefficient of friction is below about 0.15 there is a significant danger that long, slit rolls (for example, the roll geometries often employed in the motion picture industry) may become unstable in storage or shipping and become telescoped or dished (i.e., the center of the roll slides outward from the core). During the manufacturing process, telescoping may also occur while handling and shipping long master rolls of film (prior to film slitting). Thus one often faces a dilemma when designing surface protective layers for photographic elements.

In many photographic applications, resistance to scratch and abrasion is most critical after the film has been exposed and processed. For example, for a motion picture print film that is used for theater display, the processed film must be sufficiently durable to withstand perhaps 100 or more passes through a projector. The raw (unprocessed) print film is also desirably resistant to scratch and abrasion, however, it is not subjected to the same level of wear and tear as the processed film. For this reason, it has long been a practice in the motion picture industry to apply a common paste wax to the edges of a print film after processing ("edge waxing"), which process primarily provides protection in the vicinity of the film perforations where the soundtracks are located. Since the wax is applied after processing, the coefficient of friction, and therefore, the winding and roll stability of the raw print film during manufacturing, shipping, and printing are not compromised. However, while edge waxing has proved to be fairly effective, it is a time consuming and messy procedure.

The incorporation of matting agents in the outermost layers of photographic elements is also well known. These matting agents can reduce the potential for a photographic film to ferrotype when the backside of the film is in contact with the frontside (i.e., emulsion side) of the film under the pressures that are typical of, for example, a tightly wound roll of film. Ferrotyping may cause the two sides of the film to stick together, and, under severe cases of ferrotyping, damage to the emulsion side surface layer may occur when the roll is unwound. In some cases, ferrotyping may have an adverse effect on the sensitometric response of the photographic emulsion. Matting agents are also employed for such purposes as reduction of static charging and excessive sheen, pencil mark acceptance and avoidance of Newton's rings. A wide variety of materials have been employed as matting agents including both inorganic and polymeric fine particles as illustrated by *Research Disclosure*, Item 38957, pages 615–616, September, 1996.

Large quantities of matting agents are often employed for the purposes described above. However, the use of a large quantity of matting agent may result in undesirable side effects such as increased haze and graininess of the processed image. To overcome these limitations, a matting agent that is removed during film processing is often employed in place of "permanent" matting agents. Such "removable" or "soluble" matting agents are typically alkali soluble polymeric matte particles comprising, for example, a copolymer of methyl methacrylate and methacrylic acid. Soluble matte particles are described, for example, in U.S. Pat. Nos. 2,322,037; 2,992,101; 3,767,448; 4,094,848; 4,142,894; 4,447,525 and 4,524,131.

Composite particles comprising wax (or lubricant) and polymer, and uses of such composite particles in photographic element layers, have been described previously in U.S. Pat. Nos. 5,695,919, 5,958,658 and 6,165,702. Although these references generally relate to composite wax particles, they are primarily directed towards providing lubricants especially suited for dispersibility in organic solvent coating systems. These references do not teach or suggest the use or benefits of a protective surface layer containing a composite wax particle having a polymer phase which is soluble in alkaline photographic processing solutions.

It would be desirable to provide an improved surface protective layer for photographic elements that is easily manufactured and that has both very good resistance to scratch and abrasion after photographic processing and which is not prone to telescoping during manufacture, storage, and shipping.

SUMMARY OF THE INVENTION

In accordance with the present invention there is provided an unprocessed photographic element comprising a support, at least one image-forming layer, and at least one surface protective layer that contains a polymeric binder and composite wax particles having a wax phase and a polymer phase, wherein the polymer phase is soluble in alkaline photographic processing solutions. The surface protective layer of elements in accordance with the invention advantageously enables a change in frictional characteristics after film processing in alkaline solutions which enables the photographic element to have both pre-processed wound roll stability and high post-processed lubricity.

DETAILED DESCRIPTION OF THE INVENTION

The surface protective layers of the invention contain composite wax particles that are composed of a wax phase and a polymer phase, wherein the polymer phase is soluble in alkaline photographic processing solutions. The composite wax particles typically will comprise from 20 to 80 weight % wax phase based on the total weight of the composite wax particle, preferably from 30 to 70 weight % wax phase, and more preferably from 40 to 60 weight % wax phase. The surface protective layers of the invention are particularly advantageous because they provide frictional characteristics that can be optimized to give raw film wound roll stability, and processed film high lubricity and resistance to scratch and abrasion.

The polymer phase of the composite wax particles may comprise any polymer composition which is insoluble in neutral water and soluble in alkaline solutions such as photographic processing solutions. To provide such functionality, the polymer phase can be prepared by interpolymerizing one or more ethylenically unsaturated monomers containing a —COOH group, a —$SO_3H$ group, or a —$PO_3H$ group with other ethylenically unsaturated monomers including, for example, acrylic monomers such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the acrylic monomers such as 2-hydroxyethyl acrylate, 2-hydroxyethyl methacrylate, and 2-hydroxypropyl methacrylate, and the nitrile and amides of the acrylic monomers such as acrylonitrile, methacrylonitrile, acrylamide and methacrylarnide. Other comonomers which may be used include vinyl acetate, poly(ethylene glycol)(meth)acrylates, N-vinyl-2-pyrrolidone, vinylimidazole vinyl propionate, vinylidene chloride, vinyl chloride, and vinyl aromatic compounds such as styrene, t-butyl styrene and vinyl toluene. Other comonomers which may be used in conjunction with any of the foregoing monomers include dialkyl maleates, dialkyl itaconates, dialkyl methylene malonates, isoprene, and butadiene. The alkali soluble polymer phase will typically comprise a polymer which includes from 5 to 70 weight %, and preferably 10 to 40 weight %, of monomer units derived from ethylenically unsaturated monomers that contain —COOH, —$SO_3H$, or —$PO_3H$ groups. Of these, monomers containing the —COOH group are most preferred. Suitable preferred monomers containing carboxylic groups include acrylic acid, methacrylic acid, ethacrylic acid, itaconic acid, citraconic acid, maleic acid, fumaric acid, monoalkyl itaconates, and monoalkyl maleates. Additional comonomers which may be used in limited amounts (10 weight % or less, preferably 5 weight % or less) include crosslinking monomers containing 2 or more vinyl groups such as ethylene glycol dimethacrylate, allyl methacrylate, ethylene glycol diacrylate, allyl acrylate, and divinyl benzene. The soluble polymer phase may comprise polymers which have previously been proposed for use in soluble matting agent, and in particular copolymers of an alkyl methacrylate and methacrylic acid such as those described in U.S. Pat. Nos. 2,992,101; 3,767,448; 4,142,894 and 4,447,525.

Waxes useful in the composite particles of the invention are described, for example, in references such as "The Chemistry and Technology of Waxes", A. H. Warth, $2^{nd}$ Ed., Reinhold Publishing Corporation, New York, N. Y. 1956, and "Plastics Additives and Modifiers Handbook", Chapter 54–59, J. Ederibaum (Ed.), Van Nostrand Reinhold, New York, N. Y. 1992. Suitable waxes include hydrocarbon and/or ester-containing waxes, e. g. animal waxes such as beeswax, plant waxes such as carnauba wax, paraffin waxes, microcrystalline waxes, Fischer-Torpsch waxes, polyethylene waxes, polypropylene waxes, and mixtures thereof. In a preferred embodiment, the composite wax particles have a wax phase consisting of greater than 80% by weight of a wax having a melting point greater than 30° C.

The composite wax particles of the present invention preferably have a mean particle size of less than 1 micrometer. The composite wax particles are preferably prepared by polymerizing a vinyl monomer mixture in the presence of pre-formed aqueous wax particle dispersions. Pre-formed aqueous wax particle dispersions (or emulsions) are primarily composed of wax particles, dispersants/surfactants, and water. The dispersants can be nonionic, anionic, or cationic, and can be polymeric. The dispersants are used at levels as high as 20% of the wax. Wax particles can be formed by various methods known in the art. For example, they can be prepared by pulverizing and classifying dry waxes or by spray drying of a solution containing waxes followed by redipsersing the resultant particles in water using a dispersant. They can be prepared by a suspension technique which consists of dissolving a wax in, for example, a water immiscible solvent, dispersing the solution as fine liquid droplets in aqueous solution, and removing the solvent by evaporation or other suitable techniques. They can be prepared by mechanically grinding a wax material in water to a desired particle size in the presence of a dispersant, heating the wax particles dispersed in water above their melting point, and cooling the melted particles in water to form a stable wax emulsion.

In the present invention, the pre-formed aqueous wax dispersions are typically formed by the so-called "atmospheric emulsification" and "pressure emulsification" techniques. The atmospheric process is used to prepare wax dispersions for waxes with melting points below the boiling point of water. This process involves preparing a molten wax/surfactant blend (optionally a base is added to this melt blend). Hot water is then slowly added to the molten wax/surfactant blend with vigorous agitation. The wax dispersion can also be formed by adding the molten wax/surfactant blend to boiling water with vigorous agitation. Pressure emulsification is generally employed for waxes with melting points greater than 100° C. This process is similar to the process described above except it involves temperatures above the boiling point of water. Vessels capable of withstanding high pressures are normally employed.

Polymerization of vinyl monomer mixtures in the presence of preformed aqueous wax particle dispersions which may be used for formation of the composite wax particles of the present invention may be initiated and maintained with an initiating agent or catalyst, which is very similar to those used in conventional emulsion polymerization. Most useful catalysts for the practice of the present invention are azo, diazo, and peroxide compounds, for example, benzoyl peroxide, azobisisobytyronitrile and azobiscyanovaleric acid. The amount of the initiator employed follows the general practice in conventional emulsion polymerization. In general, the amounts can vary within the range of about 0.2 to 3 or 4 weight % or possibly higher by weight of the total monomers. It is generally recognized that higher level of initiators tends to result in lower molecular weight for the ultimate polymers. If the polymerization is carried out in multiple stages, the amount of initiators in the beginning or initiating stage is adjusted to match the proportion of the monomer then present, and further initiators are fed during the delayed feed stage to correspond to the delayed feed of the monomers. Basically, in any case, the initiators are supplied as needed to maintain the reaction in smooth and easily controlled conditions. Surfactants that can be used in the present invention include, for example, a sulfate, a sulfonate, a cationic compound, an amphoteric compound, and a polymeric protective colloid. Specific examples are described in "McCUTCHEON'S Volume 1: Emulsifiers & Detergents, 1995, North American Edition". Chain transfer agents may also be used to control the properties of the polymer particles formed.

Generally speaking, the reaction conditions employed in the execution of the present method parallel those utilized in conventional emulsion polymerization as regards such variables as temperature, time, agitation, equipment, etc. The reaction temperature can be maintained at a constant value or can vary from 50 to 80 or 90° C. If the reaction temperature varies, the starting temperature is usually around 50 to 55° C., and as the reaction proceeds exothermically, the temperature rses.

The time of the reaction is difficult to predict since it will depend upon other variables, such as the amount of initiating agent introduced, the reaction temperature, etc. If the amount of monomer is small, the reaction may be finished within about an hour but with larger amounts, the reaction will usually continue for 3 to 4 hours. Post-heating stages after all monomer has been added can be used to insure that the polymerization has gone to completion and no free monomer is present. The sequence of addition of the various ingredients is not critical and can be varied. Usually, aqueous medium is first added to the reactor, then aqueous wax dispersion, and monomer in that order, all being added while the medium is thoroughly agitated, followed by the initiators, but other sequences are possible.

In one of the preferred embodiments of the invention, the polymerization process in the presence of pre-formed aqueous wax particles is carried out sequentially (see, for example, Padget, J. C. in Journal of Coating Technology, Vol 66, No. 839, pages 89 to 105, 1994). In this process, the polymerization is conducted in a monomer-starved manner.

The composite wax particles of the invention may be incorporated directly into a coating composition, the main film forming constituent of which is compatible with the composite wax particles. Alternatively, the composite wax particles may be first isolated from the aqueous dispersion, for example, by spray drying, and then be incorporated into a liquid coating composition as a dry powder. As a further alternative, the composite wax particles thus isolated may be blended into a powder coating composition.

The polymer phase contained in the composite wax particles of the invention is properly designed to have good "bonding" with the wax phase and good compatibility in the liquid coating medium. Defining compatibility of the copolymer in the coating medium can be achieved by using the concept of "polymer solubility map" (see, for example, Ramsbothan, J. in Progress in Organic Coatings, Vol 8, pages 113–141, 1980; and Wicks, Jr. Z. W., Jones, F. N., and Papas, S. P. in Organic Coatings, pages 229–239, 1992, John Wiley & Sons, Inc.). As the coating medium, either water or any of the solvents customarily used in coating compositions may be satisfactorily used. In a most preferred embodiment, the surface protective layers of the invention are applied from aqueous medium.

Surface protective layers of the present invention comprise the composite wax particles in combination with a film forming polymeric binder. The particular polymeric binder that is used is chosen so as to tailor the physical and chemical properties of the surface protective layer for the specific photographic application. In a preferred embodiment, the polymeric binder is a water soluble or water dispersible polymer. Water soluble polymers include, for example, gelatin, polyvinyl alcohol, polyvinyl pyrrolidone, cellulosics, poly styrene sulfonic acid and its alkali metal salts or ammonium salts, acrylic or methacrylic acid interpolymers, and the like. Water dispersible polymers that may be used include latex interpolymers containing ethylenically unsaturated monomers such as acrylic and methacrylic acid and their esters, styrene and its derivatives, vinyl chloride, vinylidene chloride, butadiene, acrylamides and methacrylamides, and the like. Other water dispersible polymers that may be used include polyurethane and polyester dispersions. Still further water dispersible polymers that may be used are the base neutralized, carboxylic acid-containing latex polymers described in U.S. Pat. No. 5,786,135. To permit penetration of alkaline processing solutions, the binder is preferably a hydrophillic colloid such as gelatin, or an other alkaline swellable polymer. Of these, gelatin is a most preferred binder.

The surface protective layer compositions in accordance with the invention may also contain suitable crosslinking agents including aldehydes, epoxy compounds, polyfunctional aziridines, vinyl sulfones, methoxyalkyl melamines, triazines, polyisocyanates, dioxane derivatives such as dihydroxydioxane, carbodiimides, and the like. The crosslinking agents may react with the functional groups present on the polymer binder present in the coating composition.

Conventional matte particles well known in the art may also be used in the surface protective layer compositions of the invention, such matting agents have been described in Research Disclosure No. 308, published Dec 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include: hydroxyl, carboxyl, carbodiimide, epoxide, aziridine, vinyl sulfone, sulfrnic acid, active methylene, amino, amide, allyl, and the like.

In addition to film-forming binder and composite wax particles, the surface protective layer of the invention may optionally contain surface active agents, antistatic agents (e.g., conductive polymers, conductive metal oxide particles), coating aids, charge control agents, thickeners, ultraviolet light absorbers, processing removable dyes, high boiling point solvents, colloidal inorganic particles, magnetic recording particles, abrasive particles, polymer latexes, crosslinking agents (i.e., hardeners) and secondary lubricants. There are no particular limits on the secondary lubricants that may be used. They may include, for example, perfluorinated polymers, natural and synthetic waxes, silicone fluids, stearamides, oleamides, stearic acid, lauric acid, ethylene glycol distearate, ethylene glycol monostearate, and the like.

The composite wax particles and any secondary lubricants employed in the outer protective layer should be employed at levels to give the layer a raw (pre-processed) coefficient of friction that ensures good transport characteristics and resistance to scratch and abrasion during manufacturing and customer use, while not compromising pre-processed wound roll stability, and a lower post-processed coefficient of friction to further improve resistance to scratch and abrasion after processing. Preferably, the surface protective layer contains at least 2 $mg/m^2$ of the composite wax particles, more preferably from 2 to 200 $mg/m^2$, and most preferably from 10 to 100 $mg/m^2$. In preferred embodiments of the invention, the use of composite wax particles in a surface protective layer in accordance with the invention provides a decrease in coefficient of friction upon processing of at least 0.02, more preferably at least 0.04, and most preferably at least 0.06. For satisfactory transport characteristics the layer should have a coefficient of friction (both raw and post-processing) of less than 0.4, more preferably less 0.3. For wound roll stability, however, a raw (pre-processing) (coefficient of friction of at least 0.15, and more preferably at least 0.2, is desired. To further improve resistance to scratch and abrasion after processing, a coefficient of friction of less than 0.2 is further preferable.

The surface protective layers of the present invention may be applied from coating formulations containing up to 20% total solids by coating methods well known in the art. For example, hopper coating, gravure coating, skim pan/air knife coating, spray coating, and other methods may be used with very satisfactory results. The coatings are dried at temperatures up to 150° C. to give dry coating weight of 20 $mg/m^2$ to 10 $g/m^2$.

The surface protective layer of the invention may be present on either one or both sides of the support, i.e., on a "front side" as the protective overcoat for a photographic emulsion layer or on a "back side" opposite to the photographic emulsion layer and serve as an outermost backing layer. The surface protective layer may be coated, e.g., as an outermost layer coated on the top of an abrasion resistance backing layer, an outermost layer coated on the top of an antistatic layer, or an outermost layer coated on a magnetic recording layer.

The surface protective layer is most preferably used as the protective overcoat for a photographic emulsion layer.

The photographic elements of the present invention can be simple black-and-white or monochrome elements or they can be multilayer and/or multicolor elements. Color photographic elements typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art. The photographic elements of this invention can be of many different types depending on the particular use for which they are intended, for example, photographic film, photographic paper, black-and-white photographic film or paper, color photographic film or paper, negative or reversal photographic film, graphic arts film or paper, X-ray film, motion picture film, and the like. Details with respect to the composition and function of a wide variety of different photographic elements are provided in U.S. Pat. No. 5,300,676 and references described therein.

Photographic element supports can comprise various polymeric films, papers, glass, and the like, but both acetate and polyester supports well known in the art are preferred. The thickness of the support is not critical. Conventional support member thicknesses of from about 50 to 250 microns (2 to 10 mils, or 0.002 to 0.010 inches) can be employed, for example, with very satisfactory results. The supports typically employ an undercoat or subbing layer well known in the art that comprises, for example, for polyester support a vinylidene chloride/methyl acrylate/itaconic acid terpolymer or vinylidene chloride/acrylonitrile/acrylic acid terpolymer.

The image-forming layer of a photographic element typically comprises a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

Light-sensitive silver halide emulsions which may be employed in the photographic elements of this invention can include coarse, regular or fme grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. The compositions of typical light sensitive image recording layers used in photographic elements are well known, and are not critical to the invention, as any of the known silver halide materials used in photographic materials may be used, such as those described, e.g., in *Research Disclosure*, Item 36544, September, 1994, and the references listed therein.

Photographic silver halide emulsion layers utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired. Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The use of composite wax particles in a protective overcoat layer in accordance with the invention is particularly useful for motion picture print films, where providing resistance to scratch and abrasion is most critical after the film has been exposed and processed, while winding and roll stability of the raw print film during manufacturing, shipping, and printing is preferably not compromised. A color motion picture photographic print element in accordance with preferred embodiments of the invention comprises a support bearing, in order, a yellow dye image-forming unit comprising at least one blue-sensitive silver halide emulsion layer having associated therewith at least one yellow dye-forming coupler, a cyan dye image-forming unit comprised of at least one red-sensitive silver halide emulsion layer having associated therewith at least one cyan dye-forming coupler, and a magenta dye image-forming unit comprising at least one green-sensitive silver halide emulsion layer having associated therewith at least one magenta dye-forming coupler, and on either side thereof a surface protective layer as described herein. Each of the cyan, magenta, and yellow image forming units may be comprised of a single light-sensitive layer, a pack of two light-sensitive layers with one being more light sensitive and the other being less light-sensitive, or a pack of three or more light-sensitive layers of varying light-sensitivity. Photographic print films typically use relatively small grain, high chloride emulsions (e.g., emulsions having average grain size equivalent circular diameters of less than about 1 micron and halide contents of greater than 50 mole % chloride) in order to optimize print image quality and enable rapid processing. Such emulsions typically result in relatively low speed photographic elements in comparison to camera negative films. Low speed is compensated for by the use of relatively high intensity print lamps or lasers for exposing such print elements. For comparison purposes, it is noted that motion picture color print films, e.g., when rated using the same international standards criteria used for rating camera negative films, would typically have an ISO speed rating of less than 10, which is several stops slower than the slowest camera negative fihns in current use. Representative silver halide emulsion layers suitable for color motion picture print film which may be used in the elements of the invention are described, e.g., in Example 2 of U.S. Pat. No. 6,221,571, the disclosure of which is incorporated by reference herein.

In addition to one or more imaging layer and a surface protective layer, the elements of the present invention can contain auxiliary layers conventional in photographic elements, such as primer layers, subbing layers, spacer layers, filter layers, interlayers, antihalation layers, pH lowering layers (sometimes referred to as acid layers and neutralizing layers), magnetic recording layers, timing layers, opaque reflecting layers, opaque light-absorbing layers, barrier layers and antistatic layers, and the like. Details regarding supports and other layers of the photographic elements of this invention are contained in Research Disclosure, Item 36544, September, 1994.

In preferred embodiments, the elements of the invention may include an antihalation undercoat between the support and the silver halide emulsion layer, and an antistatic layer on either side of the support. The antihalation undercoat functions to prevent light from being reflected into the silver halide emulsion layer(s) and thereby causing an undesired spreading of the image which is known as halation. Any of the filter dyes known to the photographic art can be used in the present invention as a means of reducing halation. Thus, for example, water-soluble dyes can be used for this purpose. Such dyes should be incorporated in the antihalation undercoat with a mordant to prevent dye diffusion. Alternatively, and preferably, a solid particle filter dye is incorporated in the antihalation undercoat.

Useful water-soluble filter dyes for the purpose of this invention include the pyrazolone oxonol dyes of U.S. Pat. No. 2,274,782, the solubilized diaryl azo dyes of U.S. Pat. No. 2,956,879, the solubilized styryl and butadienyl dyes of U.S. Pat. Nos. 3,423,207 and 3,384,487, the merocyanine dyes of U.S. Pat. No. 2,527,583, the merocyanine and oxonol dyes of U.S. Pat. Nos. 3,486,897; 3,652,284 and 3,718,472, the enamino hemioxonol dyes of U.S. Pat. No. 3,976,661, the cyanomethyl sulfone-derived merocyanines of U.S. Pat. No. 3,723,154, the thiazolidones, benzotriazoles, and thiazolothiazoles of U.S. Pat. Nos. 2,739,888; 3,253,921; 3,250,617 and 2,739,971, the triazoles of U.S. Pat. No. 3,004,896, and the hemioxonols of U.S. Pat. Nos. 3,125,597 and 4,045, 229. Useful mordants are described, for example, in U.S. Pat. Nos. 3,282,699; 3,455, 693; 3,438,779 and 3,795,519.

Preferred examples of solid particle filter dyes for use in antihalation undercoat layers include those which are substantially insoluble at aqueous coating pH's of less than 7, and readily soluble or decolorizable in aqueous photographic processing solutions at pH of 8 or above, so as to be removed from or decolorized in a photographic element upon photographic processing. By substantially insoluble is meant dyes having a solubility of less than 1% by weight, preferably less than 0.1% by weight. Such dyes are generally of the formula:

$$D—(X)_n$$

where D represents a residue of a substantially insoluble compound having a chromophoric group, X represents a group having an ionizable proton bonded to D either directly or through a bivalent bonding group, and n is 1–7. The residue of a compound having a chromophoric group may be selected from conventional dye classes, including, e.g., oxonol dyes, merocyanine dyes, cyanine dyes, arylidene dyes, azomethine dyes, triphenylmethane dyes, azo dyes, and anthraquinone dyes. The group having an ionizable proton preferably has a pKa (acid dissociation constant) value measured in a mixed solvent of water and ethanol at 1:1 volume ratio within the range of 4 to 11, and may be, e.g., a carboxyl group, a sulfonamido group, a sulfamoyl group, a sulfonylcarbamoyl group, a carbonylsulfamoyl group, a hydroxy group, and the enol group of a oxanol dye or ammonium salts thereof. The filter dye should have a log P hydrophobicity parameter of from 0–6 in its non-ionized state. Such general class of ionizable filter dyes is well known in the photographic art, and includes, e.g., dyes disclosed for use in the form of aqueous solid particle dye dispersions as described in International Patent Publication WO 88/04794, European patent applications EP 594 973; EP 549 089; EP 546 163 and EP 430 180; U.S. Pat. Nos. 4,803,150; 4,855,221; 4,857,446; 4,900,652; 4,900,653; 4,940,654; 4,948,717; 4,948,718; 4,950,586; 4,988,611; 4,994,356; 5,098,820; 5,213,956; 5,260,179 and 5,266,454; the disclosures of each of which are herein incorporated by reference. Such dyes are generally described as being insoluble in aqueous solutions at pH below 7, and readily soluble or decolorizable in aqueous photographic processing solutions at pH 8 or above.

In a particularly preferred embodiment, the elements of the invention may include an antistatic layer whose antistatic properties survive film processing. Useful antistatic layers may include a variety of electrically conductive metal-containing particles, such as metal oxides, dispersed in a binder material. Examples of useful electrically conductive metal-containing particles include donor-doped metal oxides, metal oxides containing oxygen deficiencies, and conductive nitrides, carbides, and borides. Specific examples of particularly useful particles include conductive $TiO_2$, $SnO_2$, $V_2O_5$, $Al_2O_3$, $ZrO_2$, $In_2O_3$, ZnO, $ZnSb_2O_6$, $InSbO_4$, $TiB_2$, $ZrB_2$, $NbB_2$, $TaB_2$, CrB, MoB, WB, $LaB_6$, ZrN, TiN, WC, HfC, HfN, and ZrC. Examples of the patents describing these electrically conductive particles include; U.S. Pat. Nos. 4,275,103; 4,394,441; 4,416,963; 4,418,141; 4,431,764; 4,495,276; 4,571,361; 4,999,276; 5,122,445 and 5,368,995. Other useful electrically conductive materials for use in antistatic layers of this invention include:

Semiconductive metal salts such as cuprous iodide as described in U.S. Pat. Nos. 3,245,833; 3,428,451 and 5,075,171.

Fibrous conductive powders comprising, for example, antimony-doped tin oxide coated onto non-conductive potassium titanate whiskers as described in U.S. Pat. Nos. 4,845,369 and 5,116,666.

Conductive polymers, such as, the cross-linked vinylbenzyl quaternary ammonium polymers of U.S. Pat. Nos. 4,070,189, the conductive polyanilines of U.S. Pat. No. 4,237,194, and conductive polythiophenes of U.S. Pat. Nos. 4,987,042; 5,035,926; 5,354,613; 5,370,981; 5,372,924; 5,543,944 and 5,766,515.

A colloidal gel of vanadium pentoxide or silver-doped vanadium pentoxide as described in U.S. Pat. Nos. 4,203,769; 5,006,451; 5,221,598 and 5,284,714.

Typically, the antistatic layer is coated at a dry coverage of from 1 to 1000 mg/m$^2$ based on total dry weight. The electrical resistivity of the antistatic layer is from about 7 to about 11 log Ω/□, preferably from about 8 to 11 log Ω/□, and most preferably from about 8.5 to 10 log Ω/□.

The antistatic layer may be present on either side or both sides of the support material. The antistatic layer may be an internal layer that underlies an antihalation undercoat, protective overcoat, protective backcoat or the one or more emulsion layers. Alternatively, the antistatic layer may be an outermost layer in which the electrically conductive material is included in the protective overcoat or protective backcoat.

The following examples are used to illustrate the present invention. However, it should be understood that the invention is not limited to these illustrative examples.

EXAMPLES

Preparation of Composite Wax Particles for Use in the Coating Examples

A stirred reactor containing 151.48 g of Michemlube 155 wax dispersion (ML 155, a 25% solids aqueous wax dispersion available from Michelman, Inc. containing a blend of #1 carnauba wax and 141° F. paraffin wax) was heated to 70° C. and purged with $N_2$ for 12 hours. 0.2583 g of azobisisobutyronitrile in 2 g of toluene was then added to the reactor. An emulsion containing 44.6 g of deionized water, 11.62 g of 10% by weight Triton X100 surfactant, 3.23 g of a 10% by weight sodium dodecyl sulfonate surfactant, 32.94 g of methyl methacrylate, 5.81 g of methacrylic acid, and 0.0646 g of azobisisobutyronitrile was added continuously for 2 hours. The reaction was allowed to continue for 12 more hours before the reactor was cooled down to room temperature. The composite wax particle dispersion prepared was filtered through glass fiber to remove any coagulum.

The resultant composite wax particle dispersion has an average particle size of about 145 nm and a solids content of about 31%. The particle contains about 50% by weight wax phase based on the total weight of the composite wax particle. The polymer phase contains 85 weight % methyl methacrylate and 15 weight % methacrylic acid. The composite wax particle is designated as Wax-1.

Composite wax particle Wax-2 was prepared in a similar manner as Wax-1, except ethylene glycol dimethacrylate was included as an additional co-monomer. The compositions and other parameters for the composite wax particles are listed in Table 1.

TABLE 1

| Particle Designation | Wax Phase | Polymer Composition | Wax/ Polymer |
|---|---|---|---|
| Wax-1 | ML 155 From Michelman, Inc. | Poly(methyl methacrylate-co-methacrylic acid) 85/15 | 50/50 |
| Wax-2 | ML 155 From Michelman, Inc. | Poly(methyl methacrylate-co-methacrylic acid-co-ethylene glycol dimethacrylate) 83/15/2 | 50/50 |

Examples 1 to 4 and Comparative Samples A and B

Protective layer coating compositions containing a lime-processed gelatin binder, a vinyl sulfone gelatin hardener (used at 1.4 weight % of the gelatin binder), and either Wax-1, Wax-2, or a conventional wax dispersion (ML155) were applied from aqueous medium onto apolyethylene terephthalate film support that had been previously subbed with a vinylidene chloride-containing terpolymer latex. The coatings were chill set 4.5° C. and dried first at 20° C., and then at 38° C. to give transparent layers with a total dried coating weight of 1000 mg/m$^2$. The coefficient of fnction (COF) was determined before and after standard motion picture print film processing (Kodak ECP-2 processing) using the methods set forth in ANSI IT 9.4-1992. The coating descriptions and results are listed in Table 2.

TABLE 2

| Example | Wax | Wax Dry* Coating Weight (mg/m$^2$) | COF Before Processing | COF After Processing |
|---|---|---|---|---|
| Comparative Sample A | ML 155 | 25 | 0.17 | 0.15 |
| Comparative Sample B | ML 155 | 50 | 0.14 | 0.14 |
| Example 1 | Wax-1 | 25 | 0.28 | 0.14 |
| Example 2 | Wax-1 | 50 | 0.19 | 0.13 |
| Example 4 | Wax-2 | 25 | 0.24 | 0.15 |
| Example 5 | Wax-2 | 50 | 0.20 | 0.14 |

*for better comparison with the Comparative Samples, the wax dry coating weight for Examples 1 to 4 is the weight of the wax phase only, the dry coating weight for the composite wax particle is twice this value.

The results show that protective layers of the invention that comprise a composite wax particle provide a significant change in coefficient of friction after film processing compared with protective layers that comprise a conventional wax particle. Thus the frictional characteristics of the raw film and the processed film can be optimized independently to give both pre-processed wound roll stability and post-processed increased lubricity.

The invention has been described in detail with particular reference to certain preferred embodiments thereof, but it will be understood that variations and modifications can be effected within the spirit and scope of the invention.

What is claimed is:

1. An unprocessed photographic element comprising a support, at least one image-forming layer, and at least one surface protective layer that contains a polymeric binder and composite wax particles having a wax phase and a polymer phase, wherein the polymer phase is soluble in alkaline photographic processing solutions, the composite wax particles comprise from 20 to 80 weight % wax phase based on the total weight of the composite wax particle, and the polymeric binder comprises an alkaline swellable polymer.

2. An element according to claim 1, wherein the surface protective layer is coated on the side of the support opposite to the image-forming layer.

3. An element according to claim 1, wherein the composite wax particles comprise from 30 to 70 weight % wax phase based on the total weight of the composite wax particle.

4. An element according to claim 1, wherein the composite wax particles comprise from 40 to 60 weight % wax phase based on the total weight of the composite wax particle.

5. An element according to claim 1, wherein the image-forming layer comprises a radiation-sensitive silver halide emulsion layer.

6. An element according to claim 1, wherein the alkaline swellable polymer comprises a hydrophillic colloid.

7. An element according to claim 6, wherein the hydrophilic colloid comprises gelatin.

8. An element according to claim 1, wherein the polymer phase comprises a copolymer having 5 to 70 weight % of units derived from ethylenically unsaturated monomers that contain —COOH, —$SO_3H$, or —$PO_3H$ groups and 30–95 weight % of units derived from other ethylenically unsaturated monomers.

9. An element according to claim 8, wherein the polymer phase comprises a copolymer having 10 to 40 weight % of units derived from ethylenically unsaturated monomers that contain —COOH, —$SO_3H$, or —$PO_3H$ groups and 60–90 weight % of units derived from other ethylenically unsaturated monomers.

10. An element according to claim 8, wherein the polymer phase comprises a copolymer having 5 to 70 weight % of units derived from ethylenically unsaturated monomers that contain —COOH groups.

11. An element according to claim 8, wherein the polymer phase comprises a copolymer which comprises 5 to 70 weight % of units derived from acrylic acid, methacrylic acid, ethacrylic acid, itaconic acid, citraconic acid, maleic acid, fulmaric acid, monoalkyl itaconates, or monoalkyl maleates and 30–95 weight % of units derived from methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, 2-hydroxyethyl acrylate, 2-hydroxyethyl methacrylate, 2-hydroxypropyl methacrylate, acrylonitrile, methacrylonitrile, acrylamide or methacrylamide.

12. An element according to claim 8, wherein the polymer phase comprises a copolymer of an alkyl methacrylate and methacrylic acid.

13. An element according to claim 12, wherein the polymer phase comprises a copolymer of a methyl methacrylate and methacrylic acid.

14. An element according to claim 1, wherein the wax phase comprises greater than 80% by weight of a hydrocarbon or ester-containing wax having a melting point greater than 30° C.

15. An element according to claim 14, wherein the wax phase comprises a beeswax, carnauba wax, paraffin wax, microcrystalline wax, Fischer-Torpsch wax, polyethylene wax, polypropylene wax, or a mixture of any of such waxes.

16. An element according to claim 1, wherein the composite wax particles have a mean particle size of less than 1 micrometer.

17. An element according to claim 1, wherein the composite wax particles are prepared by polymerizing a vinyl monomer mixture in the presence of a pre-formed aqueous wax particle dispersion.

18. An element according to claim 1, wherein the surface protective layer contains at least 2 mg/m$^2$ of the composite wax particles.

19. An element according to claim 1, wherein the raw, pre-processing coefficient of friction of the surface protective layer from 0.15 to 0.40, and the coefficient of friction decreases by at least 0.02 after processing in alkaline photographic processing solutions.

20. An element according to claim 19, wherein the coefficient of friction of the surface protective layer decreases by at least 0.04 after processing in alkaline photographic processing solutions.

21. An element according to claim 19, wherein the coefficient of friction of the surface protective layer decreases by at least 0.06 after processing in alkaline photographic processing solutions.

22. An element according to claim 19, wherein the raw, pre-processing coefficient of friction of the surface protective layer from 0.15 to 0.30.

23. An element according to claim 19, wherein the coefficient of friction after processing in alkaline photographic processing solutions is less than 0.20.

24. An element according to claim 1, wherein the surface protective layer is coated over the image-forming layer.

25. A color motion picture photographic print element comprising a support bearing on one side thereof, in order, a yellow dye image-forming unit comprising at least one blue-sensitive silver halide emulsion layer having associated therewith at least one yellow dye-forming coupler, a cyan dye image-forming unit comprised of at least one red-sensitive silver halide emulsion layer having associated therewith at least one cyan dye-forming coupler, and a magenta dye image-forming unit comprising at least one green-sensitive silver halide emulsion layer having associated therewith at least one magenta dye-forming coupler, and on either side thereof a surface protective layer that contains a polymeric binder and composite wax particles having a wax phase and a polymer phase, wherein the polymer phase is soluble in alkaline photographic processing solutions, the composite wax particles comprise from 20 to 80 weight % wax phase based on the total weight of the composite wax particle, and the polymeric binder comprises an alkaline swellable polymer.

* * * * *